United States Patent [19]

Taylor et al.

[11] Patent Number: 4,508,312

[45] Date of Patent: Apr. 2, 1985

[54] RAM-TYPE BLOWOUT PREVENTER

[75] Inventors: William M. Taylor; Bolie C. Williams, III, both of Houston, Tex.

[73] Assignee: Cameron Iron Works, Inc., Houston, Tex.

[21] Appl. No.: 502,313

[22] Filed: Jun. 8, 1983

[51] Int. Cl.[3] ..... E21B 33/06

[52] U.S. Cl. ..... 251/1 A; 277/129; 277/215

[58] Field of Search ..... 277/129, 156, 195, 215; 251/1 R, 1 A

[56] References Cited

U.S. PATENT DOCUMENTS

| | | | |
|---|---|---|---|
| 1,653,439 | 12/1927 | Payne | 277/215 |
| 3,356,377 | 12/1967 | Voitik | 277/40 |
| 3,836,158 | 9/1974 | Davison et al. | 277/146 |
| 3,915,424 | 10/1975 | LeRouax | 251/1 R |
| 4,044,988 | 8/1977 | Arzumanov et al. | 251/1 A |

FOREIGN PATENT DOCUMENTS

| | | | |
|---|---|---|---|
| 2234285 | 2/1973 | Fed. Rep. of Germany | 277/215 |
| 267950 | 6/1927 | United Kingdom | 277/156 |

*Primary Examiner*—Samuel Scott
*Assistant Examiner*—Allen J. Flanigan
*Attorney, Agent, or Firm*—Vinson & Elkins

[57] ABSTRACT

A ram-type blowout preventer having a housing with a vertical bore, aligned ram guideways extending outward from opposite sides of the bore, a ram in each guideway, means for moving the rams inward and outward in the guideways to open and close on a drill or pipe string in the bore, a packer in each ram having a packing with an upper slotted plate thereon and a lower slotted plate therebelow, the plates being sufficiently flexible to move into close proximity to a string when the rams are closed thereon to support the packing against extrusion.

9 Claims, 4 Drawing Figures

RAM-TYPE BLOWOUT PREVENTER

BACKGROUND

Blowout preventers are used to maintain control of wells during drilling. Ram-type blowout preventers are used to close on the drill or pipe string to contain pressure in the well. At times it is necessary to strip or move the string through the closed rams. This stripping movement can severely wear or abrade the face of the resilient packers used in blowout preventer rams. Another reason the packers of ram-type blowout preventers are subject to wear is that to provide a seal they must tightly engage and conform to the irregular surface of the string when closed and such ability to conform causes the packers to be subject to pressure induced extrusion. The design of ram packers is thus a compromise to provide the needed conformity or feed of the resilient material with maximum abrasion and extrusion resistance.

Examples of prior ram-type blowout preventers can be seen in U.S. Pat. Nos. 2,883,141 and 3,692,316 which disclose the use of upper and lower packer plates designed to minimize extrusion damage. U.S. Pat. No. 4,323,256 discloses the use of a polytetrafluoroethylene insert in the face of the packer to minimize wear in stripping of the string through the packer. U.S. Pat. No. 2,194,258 discloses a ram-type blowout preventer having upper and lower plates of the packer which include a series of strips which are generally parallel to the ram axis and can move independently of each other to engage a drill or pipe string on which the rams have closed to provide a uniform support for the resilient packing material.

SUMMARY

The present invention relates to an improved ram-type blowout preventer with an improved packer. The blowout preventer includes a housing with a bore therethrough and one or more pairs of opposed aligned ram guideways extending outward from the bore, a ram in each of the guideways, means for moving the rams in the guideways, a packer in the front of each of the rams having an upper plate, a lower plate and resilient packing means therebetween, said plates each having a drill or pipe string receiving recess and slots allowing the upper plate to flex about the axis of said bore or said recess and engage the string when the rams are closed about the drill or pipe string.

An object of the present invention is to provide an improved ram-type blowout preventer with improved ram packer means which seals effectively on a drill or pipe string to retain well pressure.

Another object is to provide an improved ram packer which is protected from extrusion damage.

Another object of this invention is to provide an improved ram-type blowout preventer with ram front packer plates that flex or conform to effectively engage the drill or pipe string passing through the blowout preventer.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
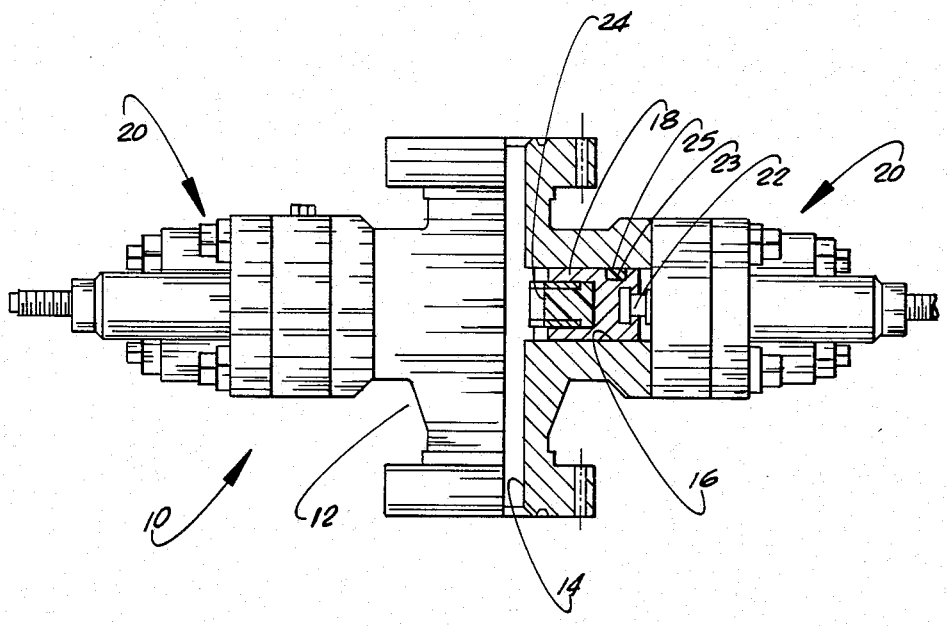
FIG. 1 is an elevation view, partly in section, of the improved blowout preventer of the present invention.

Blowout preventer 10 includes housing 12 having bore 14 with ram guideways 16 extending outward from opposite sides of bore 14, with ram 18 in each guideway 16 and having means 20, such as a piston, connected to rams 18 by connecting rods 22, for moving rams 18 inward and outward in guideway 16. Each of rams 18 includes improved front packer 24. Groove 23 extends across the top of ram 18 and seal 25 is positioned therein to provide a seal extending from packer 24 on each side and across the top of ram 18, as is known in the art and shown in U.S. Pat. No. 3,102,709. While blowout preventer 10 shown in FIG. 1 only shows one guideway 16 it has two such guideways and each has substantially identical but opposed structure including ram 18.

Figure 2:
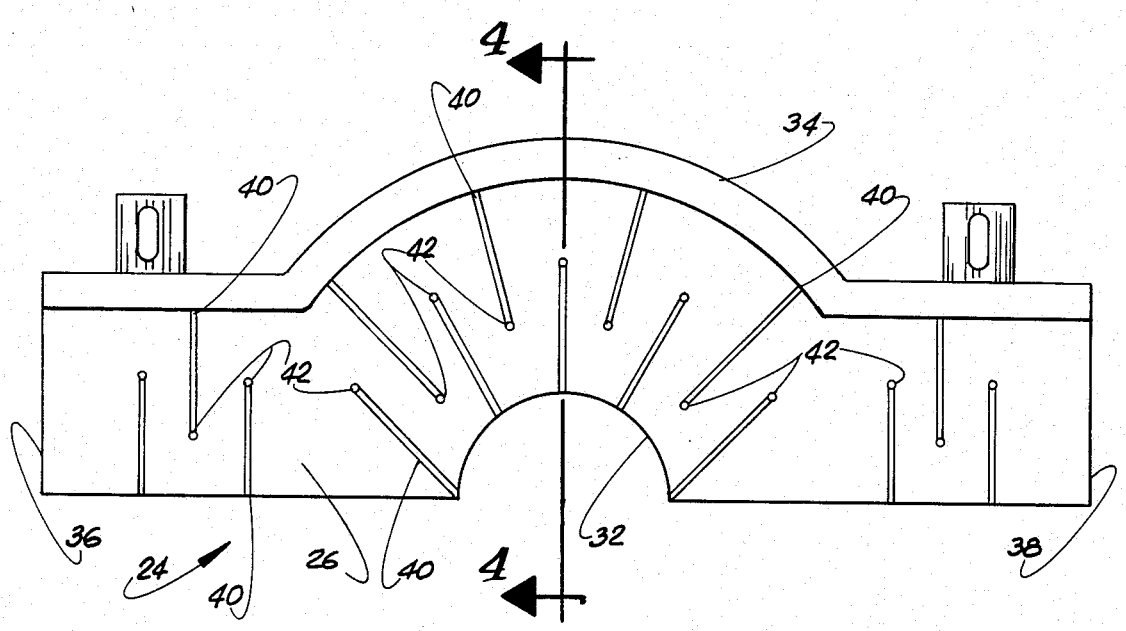
FIG. 2 is a plan view of the improved drill or pipe string receiving ram packer of the present invention in relaxed position with the ram not shown.
Figure 4:
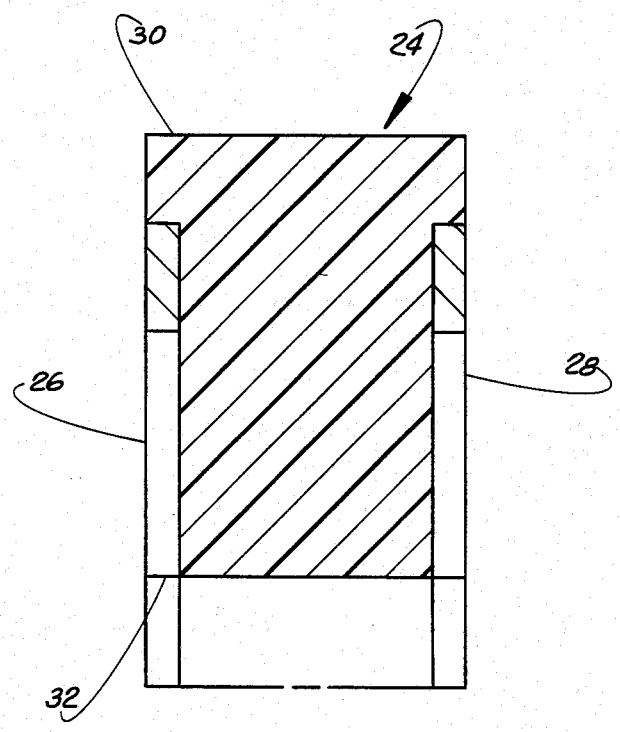
FIG. 4 is a sectional view of the packer taken along line 4—4 in FIG. 2.

As shown in FIGS. 2 and 4, packer 24 includes upper plate 26, lower plate 28 and resilient packing 30 between plates 26 and 28. Each of plates 26 and 28 include face or front recess 32, rear projections 34 and side portions 36 and 38. Also each of plates 26 and 28 has a plurality of slots 40 starting in holes 42 and extending to the front or rear surfaces of plates 26 and 28. It is preferred that slots 40 are substantially perpendicular to the surface on which they open. Holes 42 are provided to avoid any stress concentration in the plates.

Figure 3:
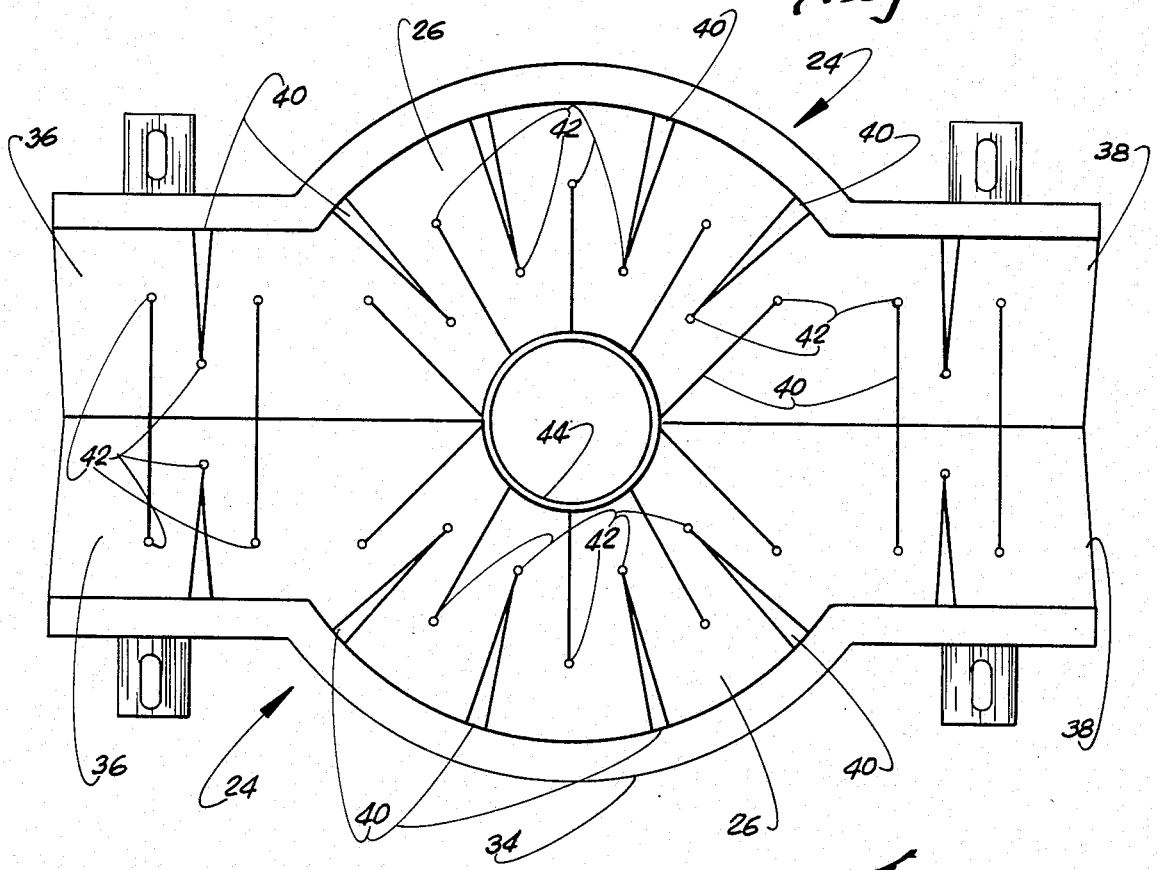
FIG. 3 is a plan view of two opposed packers of FIG. 2 with their rams not shown engaging a string and showing the flexing of the plates.

The radius of recesses 32 is slightly larger than the radius of the string on which packer 24 is to seal. This allows plates 26 and 28 to flex and conform to the string 44. The closing and sealing action of a pair of packers 24 is shown in exaggerated form in FIG. 3.

As can be seen from the drawings, plates 26 and 28 are sufficiently flexible to move into close proximity to or into engagement with string 44 to provide a substantially continuous support of resilient packing 30 around string 44 whereby extrusion of resilient packing 30 is prevented.

With the improved support supplied by the improved flexible plates it is possible to use a resilient material for the resilient packing which flows or conforms readily to improve the sealing characteristics of the ram packers. Such material is preferred to be acrylonitrile-butadiene rubber, fluorocarbon rubber or similar solvent resistant rubber.

What is claimed is:

1. A ram-type blowout preventer comprising a housing having a bore and aligned, opposed ram guideways extending outward from said bore, a ram in each ram guideway, means for moving the rams in the guideways, a ram front packer in each of the rams and including means for sealing across the top of each ram connecting with the sides of said packer, a single unitary upper ram packer plate, a single unitary lower ram packer plate, and packing between the plates, said ram plates being embedded in said packing and slotted to be sufficiently flexible to yield and move into close proximity with a drill or pipe string in the housing bore when the rams are closed whereby the packing when sealed on the string is provided with sufficient support to prevent its extrusion.

2. A blowout preventer according to claim 1 wherein said plates include a plurality of slots.

3. A blowout preventer according to claim 1 wherein said plates include a plurality of slots extending therein from their front and rear edges.

4. A blowout preventer according to claim 1 wherein said plates have a central face recess and a central rear projection, and said plates include slots extending into said plates from said face recesses and said rear projections.

5. A ram-type blowout preventer comprising a housing having a bore and aligned, opposed ram guideways extending outward from said bore, a ram in each ram guideway, means for moving the rams in the guideways, a packer in each of the rams and including an upper plate, a lower plate, and packing between the plates, said plates having slots to provide a preselected amount of flexibility about the axis of said housing bore whereby said plates engage a drill or pipe string on which the rams are closed to protect said packing from extrusion.

6. A ram packer for a ram-type blowout preventer comprising an upper plate, a lower plate, and packing between the plates, said plates having sufficient flexibility to flex about the axis of the housing bore when the rams are closed on a drill or pipe string and move into close proximity with a string therein while having sufficient transverse rigidity to prevent extrusion of said packing.

7. A packer according to claim 6 wherein said plates include a plurality of slots.

8. A packer according to claim 6 wherein said plates include a plurality of slots extending therein from their front and rear edges.

9. A packing according to claim 6 wherein said plates have a central face recess and a central rear projection, and said plates include slots extending into said plates from said face recesses and said rear projections.

* * * * *